US005331713A

United States Patent [19]

Tipton

[11] Patent Number: 5,331,713

[45] Date of Patent: Jul. 26, 1994

[54] FLOOR SCRUBBER WITH RECYCLED CLEANING SOLUTION

[75] Inventor: Scott Tipton, Elkhart, Ind.

[73] Assignee: White Consolidated Industries, Inc., Cleveland, Ohio

[21] Appl. No.: 912,496

[22] Filed: Jul. 13, 1992

[51] Int. Cl.[5] ..... A47L 7/02

[52] U.S. Cl. ..... 15/320; 15/321; 15/353

[58] Field of Search ..... 15/320, 321, 353; 210/167, 335, 340

[56] References Cited

U.S. PATENT DOCUMENTS

| | | | |
|---|---|---|---|
| 2,972,769 | 2/1961 | Keating et al. | 15/353 |
| 3,663,984 | 5/1972 | Anthony et al. | 15/321 |
| 3,869,749 | 3/1975 | London et al. | 15/353 |
| 3,923,658 | 12/1975 | Lancaster | 210/167 |
| 4,137,599 | 2/1979 | Steyer | 15/321 |
| 4,194,263 | 3/1980 | Herpers et al. . | |
| 4,295,244 | 10/1981 | Herpers et al. . | |
| 4,348,783 | 9/1982 | Swanson et al. . | |
| 4,377,017 | 3/1983 | Herpers et al. . | |
| 4,393,538 | 7/1983 | Olson . | |
| 4,464,810 | 8/1984 | Karpanty . | |
| 4,466,155 | 8/1984 | Grave . | |
| 4,696,075 | 9/1987 | Grave | 15/353 |
| 4,741,069 | 5/1988 | Helm et al. | 15/353 |
| 4,956,891 | 9/1990 | Wulff | 15/353 |
| 5,047,157 | 9/1991 | Hoffman et al. | 210/167 |
| 5,093,955 | 3/1992 | Blehert et al. | 15/353 |

*Primary Examiner*—Stephen F. Gerrity
*Assistant Examiner*—James F. Hook
*Attorney, Agent, or Firm*—Pearne, Gordon, McCoy & Granger

[57] ABSTRACT

A floor scrubber with recycled cleaning solution provides a single cleaning solution tank. Cleaning solution is delivered to powered scrubbers, and particulate-bearing contaminated cleaning solution is vacuumed from the floor after use by the scrubbers. The particulate-laden cleaning solution is returned to the storage tank through a primary large area filter located within the storage tank. Subsequently, the partially regenerated cleaning solution is pumped out of the tank through an intermediate filter and is discharged to the scrubbers through a pair of series-connected filters capable of removing very small particles from the cleaning solution. Rechargeable batteries power the unit. The unit can be operated as a self-contained unit without servicing for a period of at least about six to eight hours.

11 Claims, 4 Drawing Sheets

FLOOR SCRUBBER WITH RECYCLED CLEANING SOLUTION

BACKGROUND OF THE INVENTION

This invention relates generally to floor cleaning devices, and more particularly, to a novel and improved floor cleaner in which a cleaning solution is recirculated or recycled to extend the amount of cleaning that can be performed with a given amount of cleaning solution.

PRIOR ART

Many floor cleaning devices do not provide for recycling of the cleaning solution. Such machines can be operated for only relatively short periods of time between dumping and refilling operations.

It is also known to provide floor cleaning devices in which the cleaning solution is recirculated or recycled to increase the extent of the cleaning operation which can be performed between the dumping and filling operations. Such machines typically provide filters, settling systems, or centrifugal separators to remove particulate matter from the cleaning solution before it is reused. Examples of such machines are illustrated in the U.S. Pat. Nos. 4,194,263; 4,295,244; 4,348,783; 4,377,017; 4,393,538; 4,464,810 and 4,466,155.

SUMMARY OF THE INVENTION

The present invention provides a compact, highly efficient recirculating floor cleaner which can be operated as a self-contained unit for an extended period of time. The illustrated embodiment can be operated continuously for about six to eight hours before it must be serviced. In effect, the cleaner can be operated, in most instances, for a full shift without service.

Such illustrated embodiment provides a battery pack of deep cycle batteries which provide all of the power requirements for the unit.

The cleaning solution is stored in and recycled through a single storage tank. The cleaning solution is delivered to powered scrubbers by a pump. The contaminated cleaning solution is then vacuumed up and returned to the storage tank.

A very efficient particulate separation system is provided to remove the contaminating particulate from the cleaning solution before the cleaning solution is recycled back to the scrubbers. Initial separation is provided by a relatively large, elongated sock-type preliminary filter draped in the storage tank. The contaminated cleaning solution is drawn by vacuum into the storage tank through the interior of the preliminary filter. As the contaminated particulate-laden cleaning solution passes through the preliminary filter into the tank itself, the larger particles are trapped within the primary filter, and the solution entering the storage tank is laden only with relatively small particles. While the solution remains in the storage tank, additional particles settle to the bottom of the storage tank to further separate particles from the cleaning solution.

A pump operates to draw the partially regenerated cleaning solution from the storage tank at a location spaced from the bottom thereof so as to minimize the entrainment of particulate matter resting on such bottom. A secondary filter is provided at the pump inlet. The pump then discharges the cleaning solution through a pair of series connected final filters from which the regenerated cleaning solution is discharged to the powered scrubbers. In the illustrated embodiment, a detergent is mixed with the cleaning solution as it passes from the final filters to the scrubber. The series connected final filters are selected to filter out even very small particles so that the recirculated cleaning solution delivered to the scrubbers is virtually free of all particulate matter.

Because substantial amounts of particulate matter have been removed from the cleaning solution before it reaches the final filters, the final filters can function effectively for a considerable period of time, even though they are not particularly large. Further, the pump is capable of delivering the cleaning solution to the final filters at a sufficient pressure so that operations can continue, even though the final filters are laden with substantial amounts of particulate matter.

With this system in which very efficient filtering is provided, it is possible to operate the unit on a substantially continuous basis from six to eight hours without servicing. At the completion of the operation, the filters are washed or replaced, the battery pack is recharged, the tank is flushed out and supplied with fresh water, and the detergent is replenished. The unit is then again ready for operation for an extended period of time.

Further, the various components of the system are structured to provide a compact unit which can be easily serviced.

These and other aspects of this invention are illustrated in the accompanying drawings and described in the following specification.

DETAILED DESCRIPTION OF THE DRAWINGS

Figure 1:
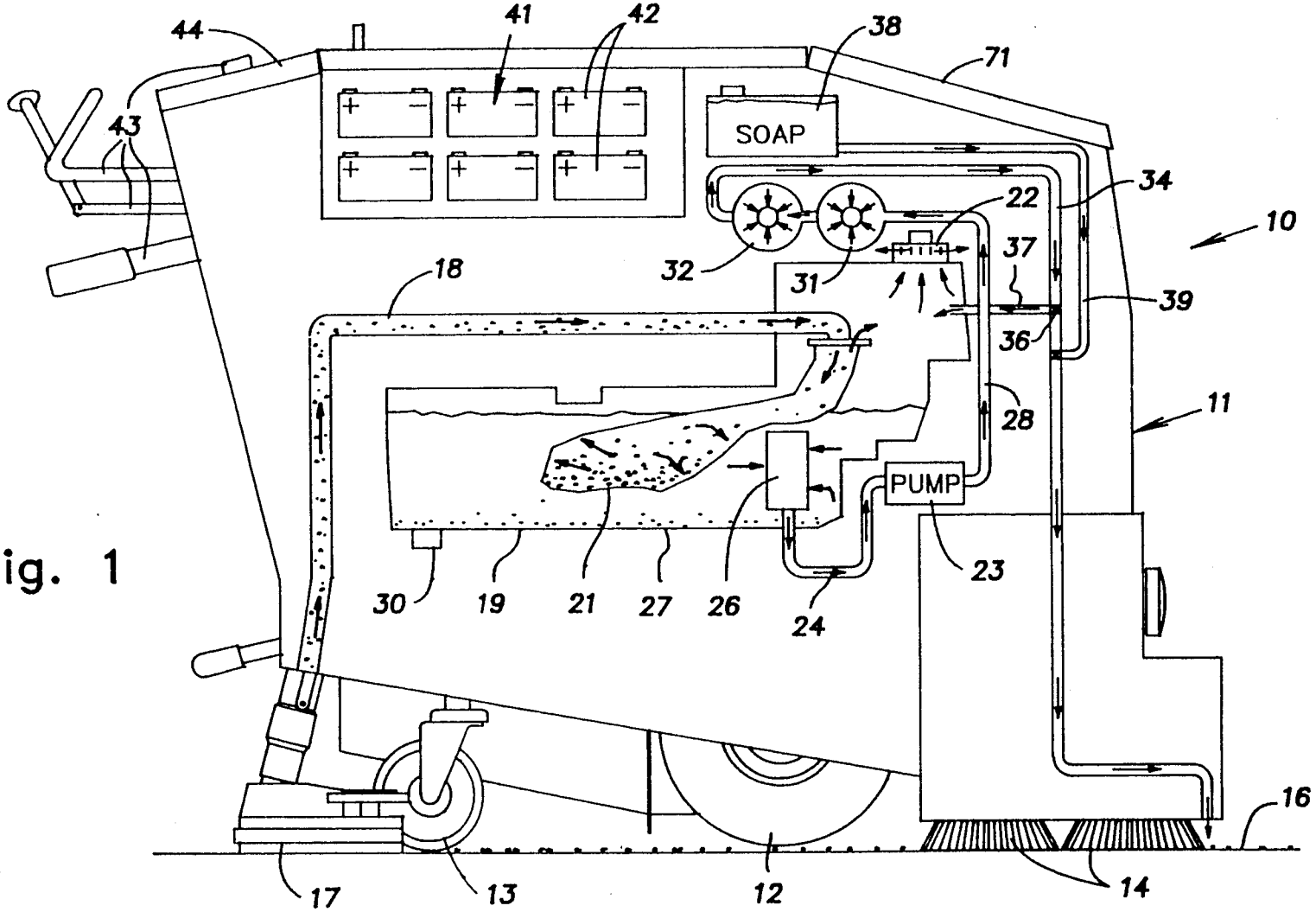
FIG. 1 is a side elevation of a floor scrubber, in accordance with the present invention, schematically illustrating the general arrangement of the operating components of the unit.

FIG. 1 schematically illustrates the overall arrangement of a floor scrubber 10, in accordance with the present invention. The unit includes a frame assembly 11 supported on main drive wheels 12 journaled on the frame assembly 11 and castor wheels 13.

Powered scrubber brushes 14 are mounted ahead of the drive wheels 12 for engagement with a floor 16 being cleaned by the unit. At the rearward end of the unit, a squeegee and vacuuming assembly 17 engages the floor which has been previously scrubbed by the scrubbers 14. The contaminated cleaning solution is vacuumed up off of the floor through a passage 18 which returns the contaminated cleaning solution to a cleaning solution tank 19 internally mounted within the frame 11.

The passage 18 delivers the contaminated water to the interior of a large sock-like primary filter 21 located within the tank 19.

The vacuum required to draw the contaminated solution from the squeegee assembly 17 through the passage 18 and into the interior of the primary filter 21 is provided by a vacuum pump 22 which maintains the tank at a vacuum. As the contaminated cleaning solution passes through the fabric of the primary filter 21, the larger particles entrained with the contaminated solution are separated and retained within the primary filter. In fact, the primary filter serves to separate a substantial majority of particles from the contaminated solution so that the liquid portion of the contaminated solution which enters the tank, per se., is relatively free of particulate matter.

A pump 23 is provided with an inlet passage 24 connecting to an intermediate or secondary filter 26 located within the tank 19 at a location spaced above the bottom wall 27 of the tank. While the cleaning solution remains within the tank 19, there is a tendency for some of the remaining particulate matter to settle down within the tank and rest upon the bottom wall 27. For this reason, the intermediate filter 26 is located at a location spaced above the bottom wall 27 of the tank. This allows the particulate matter resting against the bottom to remain in the tank as a portion of the solution is pumped out of the tank 19 through the intermediate filter to the inlet of the pump 23.

The outlet of the pump through which the recirculating cleaning solution is discharged from the pump connects with a passage 28 and is delivered to the first of two series-connected final filters 31 and 32. These filters are preferably selected to filter particles in a size range from one to one-hundred microns so that the cleaning solution passing from the second of the two filters 32 is virtually free of any particulate matter. From the second of the final filters 32, the particulate-free solution passes through a passage 34 back to the scrubbers 14. Located in the passage 34 is a flow-regulating valve 36 which is operated to control the volume of flow of cleaning solution to the scrubbers and to return any excess flow through a passage 37 back to the tank 19.

In addition, a detergent or soap storage tank 38 provides a supply of detergent which is connected through a passage 39 to the passage 34 downstream from the valve 36. As discussed in greater detail below, a controlled amount of soap or detergent is added to the regenerated cleaning solution delivered to the scrubbers 14.

As schematically illustrated at 41, a power pack 41 is provided within the housing 11 consisting of a plurality of deep cycle rechargeable batteries 42. These batteries provide all of the power for the various components of the system. For example, the batteries power the motors (not illustrated) which drive the main drive wheels 12 and the scrubbers 14. Similarly, the batteries provide the power for the pump 23 and the vacuum pump 22. Suitable controls 43 are provided on a control panel 44 at the rearward end of the scrubber 10. These controls allow the operator to control all of the various operational functions of the unit and to monitor the conditions of operation of the various components.

Figure 2:
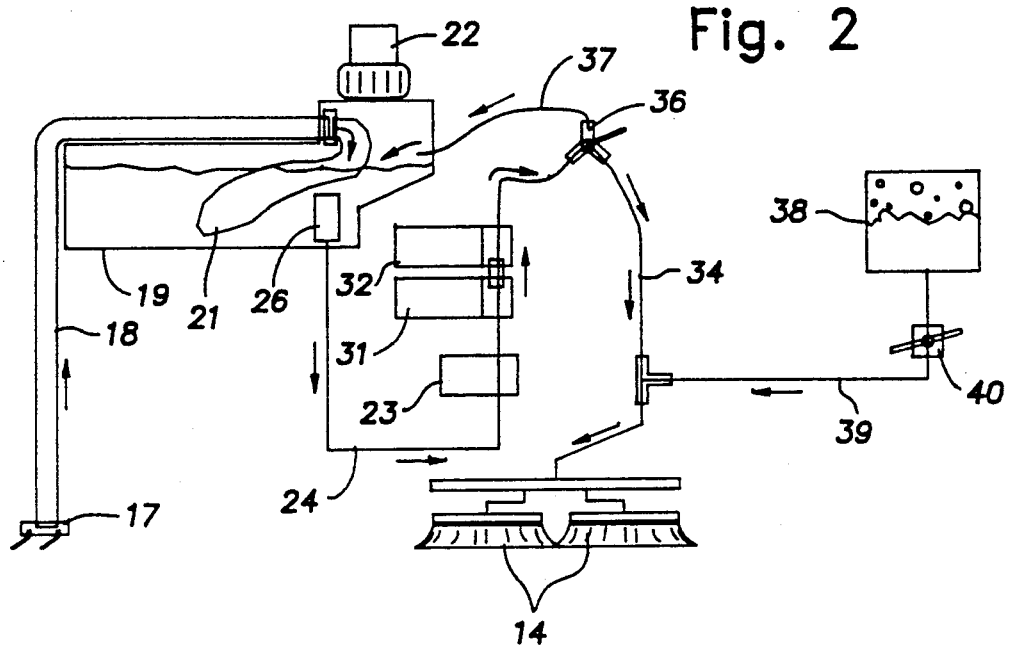
FIG. 2 is a schematic flow diagram of the cleaning solution and detergent.

FIG. 2 is a simplified schematic illustration of the functioning portions of the hydraulic circuit illustrated without the frame components and the like. In such figure, the flow-regulating valve 36 is more fully shown. Also, a flow-regulating valve 40 is illustrated in the passage between the detergent or soap container 38 and the line 34. This regulating valve 40 allows the adjustment of the ratio of detergent to cleaning solution supplied to the brushes 14 during the general operation of the scrubber. Typically, the valve 40 is adjusted so that the volume of detergent to the volume of cleaning solution is less than one to one-hundred. Further, the operator, through the operation of the valve 40, can continue to control the ratio of volumes so as to prevent excessive detergent from being added to the system.

Figure 3:
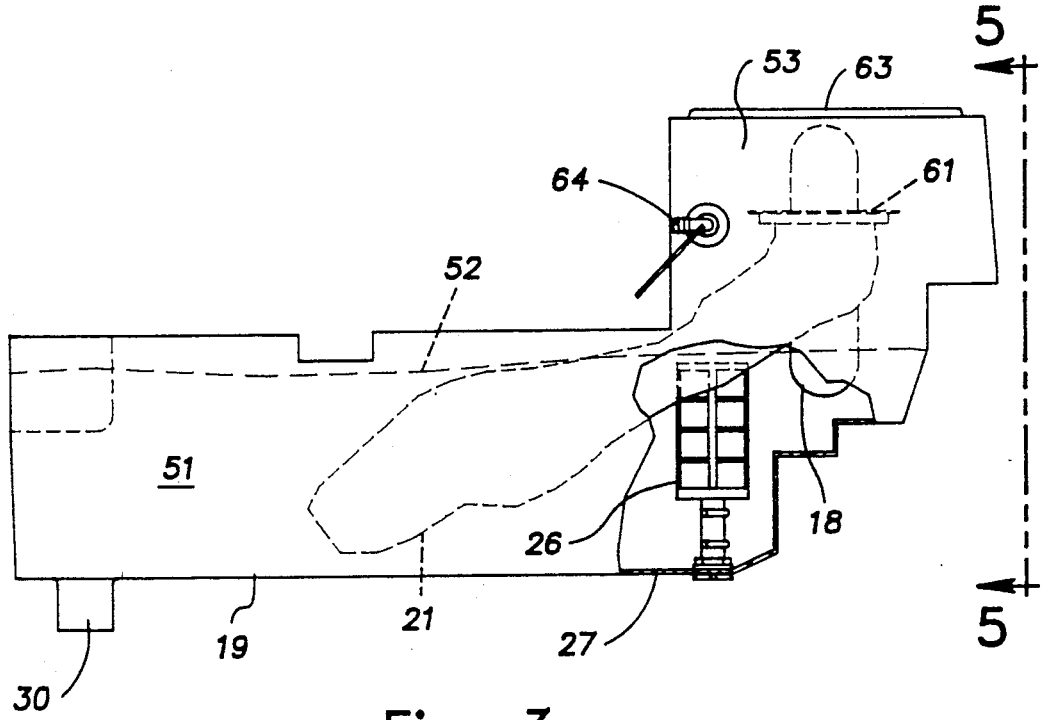
FIG. 3 is a side elevation of the cleaning solution tank partially cut away to illustrate internal components.
Figure 4:
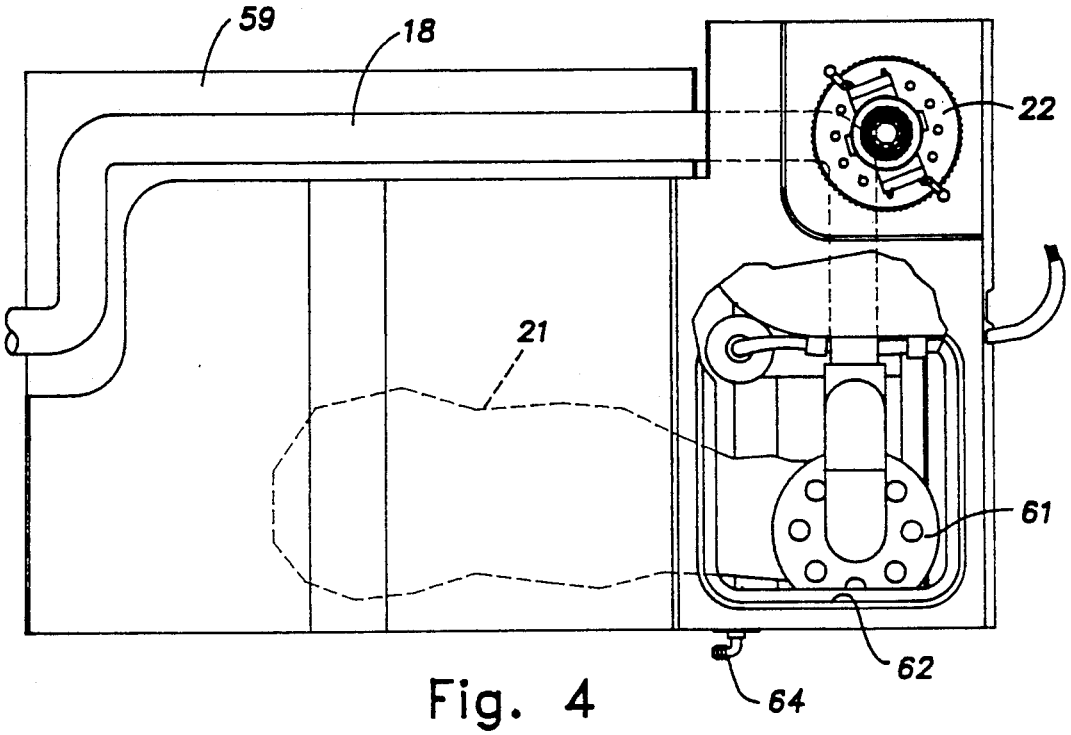
FIG. 4 is a plan view of the tank illustrated in FIG. 3.
Figure 5:
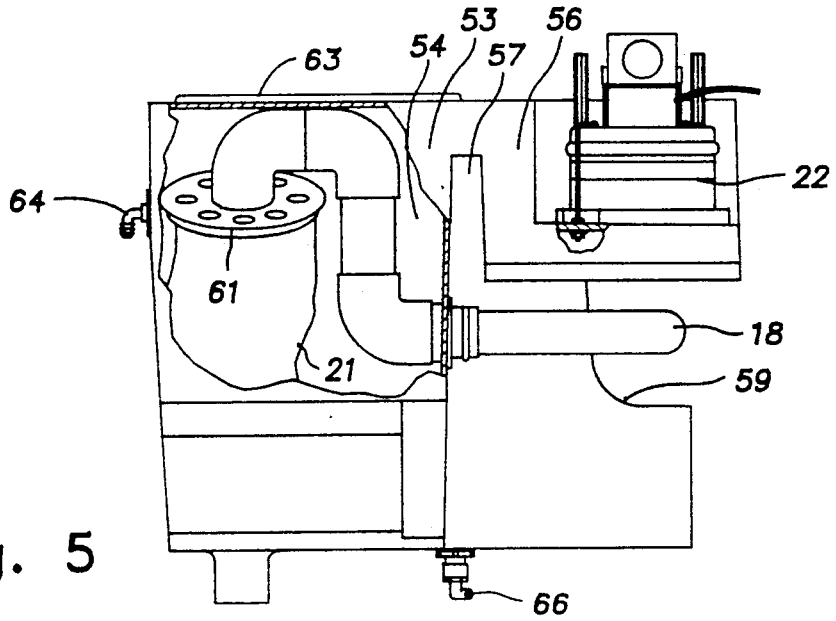
FIG. 5 is an end view taken along 5—5 of FIG. 3.

Referring to FIGS. 3–5, the tank 19 is preferably provided with a main storage zone 51 which contains substantially all of the cleaning solution schematically illustrated below the line 52. The forward end of the tank is formed with a raised portion 53 divided into a cleaning solution portion 54 and a vacuum portion 56 (see FIG. 5) by an upstanding stub wall 57. The vacuum pump 22 is located within the vacuum chamber and is isolated from the cleaning solution by the stub wall 57.

The passage 18, as best illustrated in FIGS. 4 and 5, extends along a recessed zone 59, formed along a rearward end and side of the tank. This structure provides clearance for the necessary passage 18 and allows the tank to be produced with a maximum size within the envelope of the frame 11. The primary filter 21 is connected with a fitting 61 to the end of the passage 18 immediately below an access opening 62 formed in the raised end of the tank within the portion 54. The connection 61 is released by an operator reaching through the access opening 62 when removal and cleaning of the primary filter 21 is required. During operation, the access opening 62 is closed by a cover 63 so that the vacuum pump 22 can maintain a vacuum within the tank 19. A fitting 64 is provided in the side wall of the end of the tank to connect with the bypass passage 37. Similarly, a fitting 66 is mounted in the bottom of the tank for connection of the inlet passage 24 of the pump to the intermediate filter 26.

Figure 6:
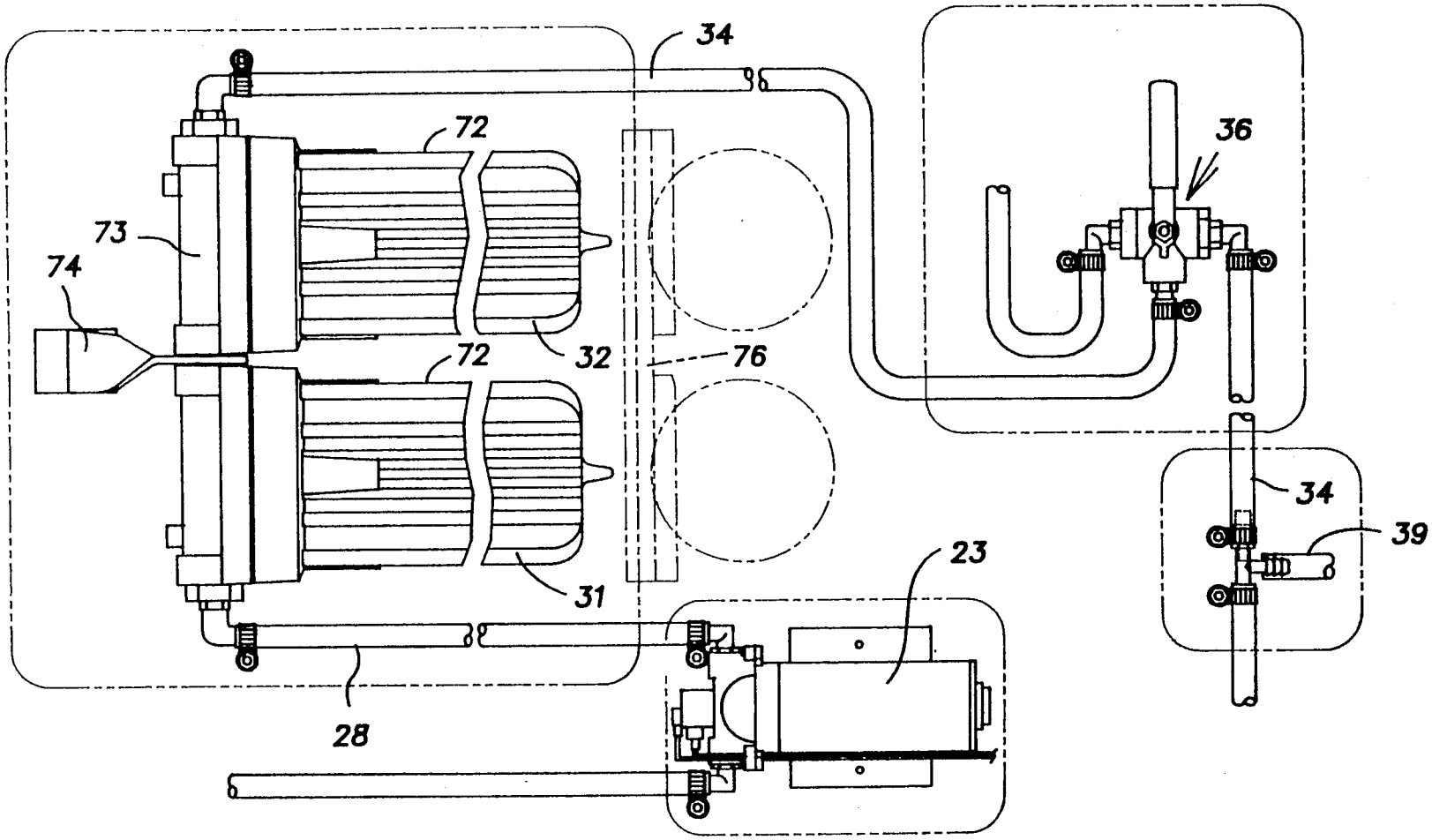
FIG. 6 illustrates the cleaning solution circuit extending from the pump to the final filters through the bypass valve and the fittings where detergent is added to the cleaning solution.

As best illustrated in FIG. 6, the two series-connected filters 31 and 32 are normally positioned in the horizontal plane within the frame 11 below a hinged cover 71. These filters are preferably of a type containing a tubular filter sleeve mounted within a removable housing 72 threaded into a header assembly 73. The recirculating cleaning solution enters the associated housing around the sleeve filter and passes through the filter into the interior thereof from which it flows back to the header. The solution then passes into and through the second filter 32. Preferably, the header 73 is connected to a hook member 74 so that when the unit requires service, the final filters can be moved out of the housing interior and hung on the edge of the forward panel 76 of the housing, as illustrated in phantom in FIG. 6. The passages 28 and 34 are formed of flexible tubing of sufficient length so that the final filters can be moved from their normal operative position, illustrated in full line, to their service position, illustrated in phantom. When the final filters are in the phantom position, access is provided to the cover 63, and in turn, through the access opening 62 into the tank.

A recirculating system, in accordance with this invention, allows virtually continuous recycling of the cleaning solution since a very effective filtering system is provided so that the cleaning solution returned to the scrubbers 14 is virtually free of any particulate matter. The primary filter 21 is large and is capable of effectively filtering out a large amount of particulate matter and retaining such particulate matter until the end of a given cycle of operation. Secondary separation is then provided by the tank itself where some of the remaining particulate matter settles to the bottom of the tank and rests against the bottom wall thereof. Intermediate filtering at the pump inlet is provided by the intermediate filter 26 which further reduces the amount of particulate matter within the recirculating cleaning solution.

The final filters are capable of removing even extremely small sized particles. Consequently, the cleaning solution recirculated back to the scrubbers is virtually completely free of particulate matter. Because substantially all of the particulate matter has been removed from the cleaning solution by the time it reaches the final filters, even relatively small filters are capable of operating for a considerable period of time without becoming overloaded or clogged. Further, since the final filters are in the discharge circuit of the pump, continued operation can be accomplished because the pump is capable of developing sufficient pressure to ensure adequate flow through the final filters, even when they are relatively highly loaded with particulate matter.

At the end of a cycle of operation, the cover 71 is opened and the final filters are moved to the service position at which they are opened allowing the sleeve filters to be removed and cleaned or replaced as required. Movement of the two filters 31 and 32 to the service position allows access to the primary filter 21 and intermediate filter 26. These are then removed and cleaned as required. The tank itself is then drained through a drain 30 in the bottom wall 27 and is flushed out to remove any particulate matter resting on such bottom wall. While this is occurring, the battery pack 41 is recharged. After cleaning and reassembling the various filters, the tank is filled with its normal supply of liquid, and the soap container is refilled with detergent. The machine is then ready for another complete cycle of operation, which typically allows continuous operation for six to eight hours before reservicing is required.

Although the preferred embodiment of this invention has been shown and described, it should be understood that various modifications and rearrangements of the parts may be resorted to without departing from the scope of the invention as disclosed and claimed herein.

What is claimed is:

1. A recirculating floor scrubber supported for movement along a floor surface, a floor scrubber frame, a combined liquid supply and recovery tank on said frame for cleaning solution, said tank providing a bottom wall, powered scrubbers on said frame, a first filter, a vacuum means for removing particulate contaminated cleaning solution from a floor and for delivering said contaminated cleaning solution to said tank through said first filter, said first filter operating to trap and contain at least the larger size particulate within said first filter, a second filter within said tank at a location spaced from said bottom wall, a pump, third filter means located between said pump and said scrubbers, said pump operable to draw cleaning solution from said tank through said second filter and to deliver such cleaning solution through said third filter means to said scrubbers, said third filter means operating to remove small particulate from said cleaning solution before delivery thereof to said scrubbers.

2. A floor scrubber as set forth in claim 1, wherein said pump provides sufficient pressure output to pump an amount of particulate-laden cleaning solution through said third filter means sufficient to permit effective operation of said scrubbers even when said third filter means are substantially loaded with particulate matter.

3. A floor scrubber as set forth in claim 2, wherein said third filter means includes two separate filters connected in series.

4. A floor scrubber as set forth in claim 2, wherein valve means are provided through which cleaning solution passes from said third filter means to said scrubber, said valve means including a bypass connected to said tank, said valve means providing control of the volume of cleaning solution delivered to said scrubbers and operating to return excess cleaning solution to said tank.

5. A floor scrubber as set forth in claim 2, wherein rechargeable batteries are mounted on said frame and operate to power all of the components of said scrubber permitting said scrubber to operate as a self-contained unit.

6. A floor scrubber as set forth in claim 5, wherein said scrubber is operable as a self-contained unit for at least about six hours.

7. A floor scrubber as set forth in claim 1, wherein said third filter means is positioned with said frame during use, and is moveable while maintaining fluid connection to a temporary position on the exterior of said frame when said scrubber is serviced.

8. A floor scrubber as set forth in claim 7, wherein said first filter is located within said tank, and said first filter is accessible through an access opening in said tank when said third filter is in said temporary position.

9. A recycling floor cleaner comprising a single tank for cleaning solution, powered scrubber means, a pair of series connected final filters, a secondary filter, a pump having an inlet and an outlet, conduit means connecting said tank to said pump inlet through said secondary filter and connecting said pump outlet to said scrubbers through said final filters, a primary filter in said tank, vacuum means operable to draw contaminated cleaning solution used by said scrubbers to clean a floor through said primary filter into said tank for redelivery to said scrubbers and reuse in cleaning, said primary filter trapping and separating particles larger than a first predetermined size within said primary filter, said final filters trapping and separating particles having a size less than said first predetermined size and greater than a substantially smaller second predetermined size so that recirculated cleaning solution delivered to said scrubbers is substantially free of particles having a size greater than said second predetermined size, some of said particles having a size less than said first predetermined size settling along the lower portion of said tank and cooperating with said primary filter to prevent substantial amounts of said particles from reaching said secondary filters when said cleaning solution is recirculated by said pump.

10. A floor scrubber as set forth in claim 9, wherein an intermediate filter is located within said tank and connected to said pump inlet.

11. A floor scrubber as set forth in claim 9, wherein a source of detergent is connected to supply detergent after the cleaning solution passes through said final filters and before reaching said scrubber means.

* * * * *

UNITED STATES PATENT AND TRADEMARK OFFICE

CERTIFICATE OF CORRECTION

PATENT NO. : 5,331,713

DATED : July 26, 1994

INVENTOR(S) : Scott Tipton

It is certified that error appears in the above-identified patent and that said Letters Patent is hereby corrected as shown below:

Column 6, line 24, (Claim 7, line 2), delete "with" and insert --within--.

Signed and Sealed this

Fourth Day of October, 1994

*Attest:*

*Attesting Officer*

BRUCE LEHMAN

*Commissioner of Patents and Trademarks*